United States Patent [19]

Watanabe

[11] 4,271,931

[45] Jun. 9, 1981

[54] ELEVATOR CONTROL DEVICE

[75] Inventor: Eiki Watanabe, Inazawa, Japan

[73] Assignee: Mitsubishi Denki Kabushiki Kaisha, Tokyo, Japan

[21] Appl. No.: 48,110

[22] Filed: Jun. 13, 1979

[30] Foreign Application Priority Data

Jun. 14, 1978 [JP] Japan ..... 53/71835

[51] Int. Cl.[3] ..... B66B 5/00

[52] U.S. Cl. ..... 187/29 R

[58] Field of Search ..... 187/29

[56] References Cited

U.S. PATENT DOCUMENTS 4,027,745 6/1977 Watanabe ..... 187/29

4,030,570 6/1977 Caputo ..... 187/29

*Primary Examiner*—J. V. Truhe

*Assistant Examiner*—W. E. Duncanson, Jr.

*Attorney, Agent, or Firm*—Sughrue, Rothwell, Mion, Zinn and Macpeak

[57] ABSTRACT

A control device for an elevator, which is made up of a position detecting device for detecting the position at which rotary elements such as the armature of an electric motor and sheaves produce vibration torque and a cancellation signal generating circuit. The circuit is employed for generating a cancellation signal to cancel the vibration torque in response to the output of the position detecting means. A control circuit is used for applying current necessary for cancelling the vibration torque to the motor by receiving the cancellation signal. Even if the vibration is caused by the eccentricity of the rotary elements or by the torque ripples generated by the armature of the motor, it is not sensed by the persons in the elevator cage.

10 Claims, 4 Drawing Figures

ELEVATOR CONTROL DEVICE

BACKGROUND OF THE INVENTION

This invention relates to an improvement of a device adapted to control an elevator.

The armature of an electric motor for driving an elevator, a traction sheave, a secondary sheave and a tension sheave are rotary elements which are precisely machined. However, they are still somewhat eccentric, and unbalanced in terms of moments. The armature may, for example, produce torque ripples. Therefore, if the frequency of the force of vibration generated by these rotary elements coincides with the inherent frequency of the main rope or the compensation rope of the elevator, individuals in the cage can feel the vibration. That is, they sense the vibrations and can be uncomfortable given the environment of an elevator.

Especially in the case of an elevator extending over long distances, the vibration is liable to be caused in the cage because the inherent frequency of the main rope or the compensation rope is low. In such an elevator, the vibration of the main rope is amplified ten to twenty times, and therefore the slight force of vibration produced by the rotary elements greatly affects the vibration values in the cage.

SUMMARY OF THE INVENTION

Accordingly, an object of this invention is to eliminate all of the above-described drawbacks in the prior art.

More specifically, an object of the invention is to provide a control device for an elevator, in which even if vibration is caused by the eccentricity of the rotary elements such as the armature and the sheaves driving the cage or by the torque ripples of the armature, the vibration is not sensed by the persons in the cage.

In an elevator having a driving electric motor, a traction sheave is driven directly by the motor. A secondary sheave and a tension sheave are driven through ropes connected to the cage by the motor. A control device, according to this invention, comprises; position detecting means for detecting a position at which vibration torque is caused, a cancellation signal generating circuit for providing a cancellation signal in response to the output of the position detecting means, and a control circuit for receiving the cancellation signal to apply current necessary for cancelling the vibration torque to the motor.

In one preferred embodiment of the invention, the control device further comprises: a speed range detecting circuit which is operated when the speed of the cage is in a predetermined range, and contact means for connecting the cancellation signal generating circuit to the control circuit when the speed range detecting circuit is operated.

DETAILED DESCRIPTION OF THE INVENTION

Figure 1:
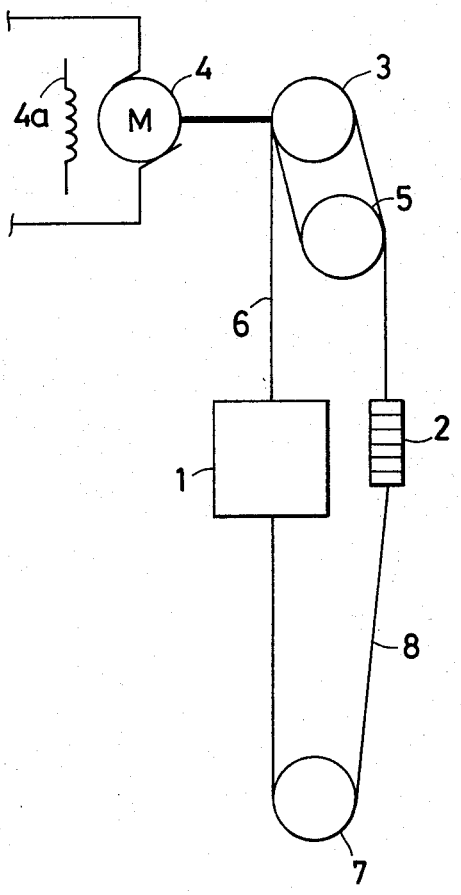
FIG. 1 PRIOR ART
FIG. 1 is an explanatory diagram showing the arrangement of a rope type elevator.

FIG. 1 shows the arrangement of a traction type elevator. In FIG. 1, reference numeral 1 designates a cage; and a counter weight is designated as 2. A traction sheave 3 and the armature 4 of an electric motor used for driving the traction sheave is also shown. Element 4*a* is a shunt field; and element 5 is a secondary sheave. A main rope 6 is wound on the traction sheave 3 and the secondary sheave 5 to connect the cage 1 to the counter weight 2. A compensator sheave 7 has a compensation rope 8 wound around it and connected at its ends to the cage 1 and the counter weight 2.

It is well known in the art that, in an elevator running for a long distance, the inherent frequency of the main rope 6 or the compensation rope 8 is low. The armature 4, the traction sheave 3, the secondary sheave 5 and the compensator sheave 7 are rotary elements which have been precisely machined. However, they tend to be somewhat eccentric, and unbalanced in moments of inertia. The armature may produce torque ripples. Therefore, if the frequency of the force of vibration generated by the rotary elements 3, 4, 5 and 7 coincides with the inherent frequency of the main rope 6 or the compensation rope 8, then persons in the cage can feel the vibration. That is, they can become uncomfortable by the vibrations sensed while passengers. When the amplification factor of the vibration of the main rope 6 reaches ten to twenty times, the slight force of vibration of the rotary elements 3, 4, 5 and 7 greatly affects the cage. Given this general background, this invention is directed toward a control device for an elevator, in which, even if vibration is caused by the eccentricity of the rotary elements such as the armature and the sheaves driving the cage or by the torque ripples of the armature (4), the vibration is not sensed by the persons in the cage. One preferred embodiment of this invention will be described with reference to FIGS. 2 to 4.

Figure 2:
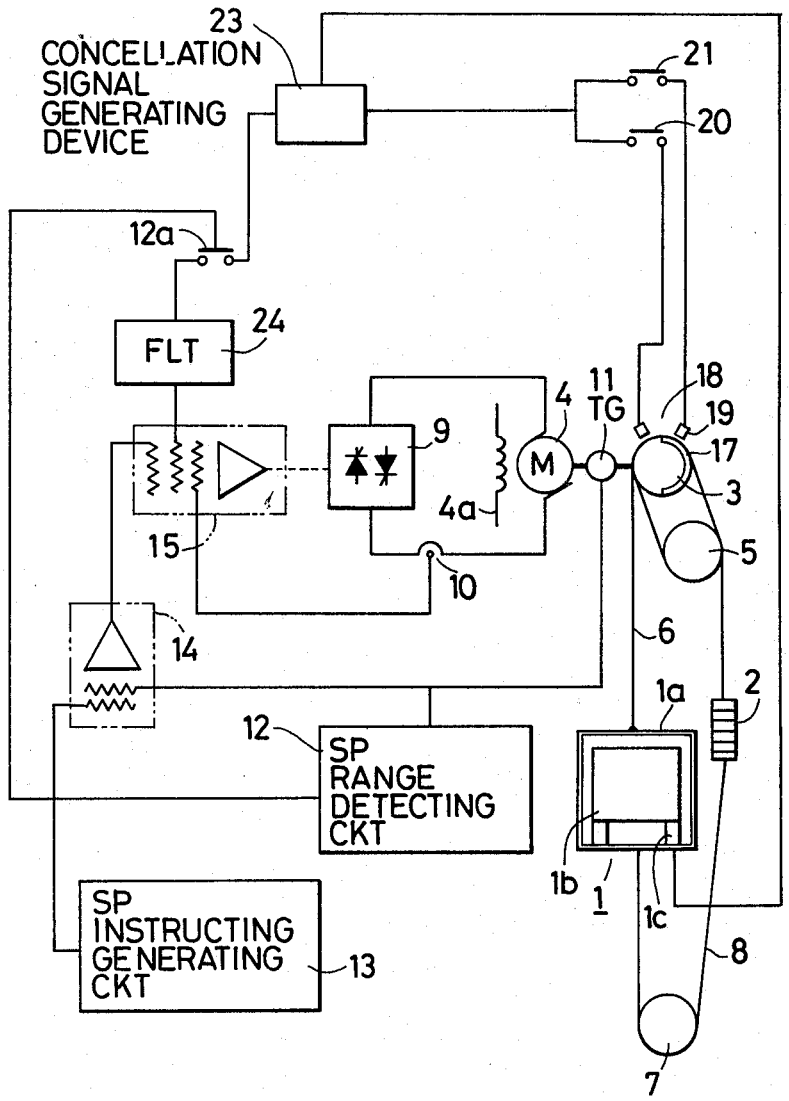
FIG. 2 is also an explanatory diagram showing one example of a control device for an elevator, according to this invention.

In FIG. 2, reference characters 1*a* designates a cage frame connected to the main rope 6; 1*b*, a cage chamber and 1*c*, a load detecting device for detecting the load in the cage chamber 1*b*. A thyristor converter 9 supplies DC power to the armature 4. A current detector 10 detects the current of the armature 4. A tachometer generator 11 is driven by the armature 4 to produce an output speed signal. A speed range detecting circuit 12 which is employed when a speed range in which the frequency of the vibration generated by the above-described rotary elements 3, 4, 5 and 7 coincides with the inherent frequency of the main rope 6 or the compensation rope 8 is obtained, is operated to close a contact means 12*a*.

A speed pattern generator 13 produces an output to a speed amplifier 14 coupled to a current amplifier 15. A magnetic element 17 is provided on the peripheral portion of the traction sheave 3 along half round. An upward movement position detector 18 is closed when it confronts the magnetic element 17 and a downward movement position detector 19 similar to the position detector 18 is also provided. Position detectors 18 and 19 are reed switches. And instead of magentic device, photo electric device can be applied. An upward movement relay contact 20 is closed when the cage 1 is moved upwardly and a downward movement relay contact 21 similar to the relay contact means 20 is provided for downward movement. A cancellation signal generating device 23 is provided for generating a signal to cancel the vibration and a filter 24 is provided to complete the circuit. Thus, the +15 V supply shown in FIG. 3 is applied to AMP1 at different times depending on the direction of travel of the elevator.

Figure 3:
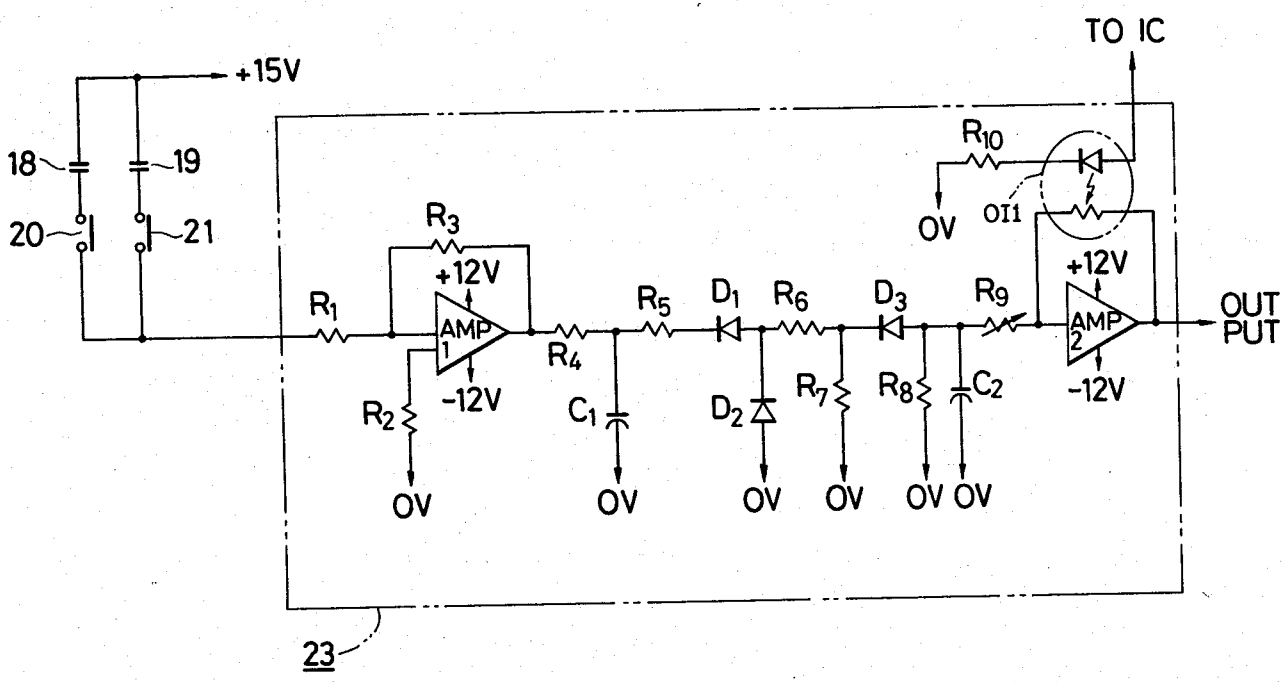
FIGS. 3 and 4 are circuits showing one example of a cancelling signal generating device and a speed range detecting circuit respectively, according to this invention.

In FIG. 3, a circuit of a cancelling signal generating device 23 is shown.

R1 and R10 are resistors, C1 to C2 are capacitors, D1 to D3 are diodes, AMP1 and AMP2 are high gain operational amplifiers and OI1 is a CdS opto-isolator. In FIG. 3, when contact 20 is closed during upward movement, and magnet 17 is positioned adjacent reed switch 18 to thereby close switch 18, the +15 V supply is applied to AMP1, to thereby switch the output of AMP1 from 0 to −10 V. The negative voltage applied from the output of AMP1 across diodes D1 and D3 to the input of AMP2 causes AMP2 to switch from 0 to a positive voltage determined by the ratio of resistance values for resistors R9 and 0I1. As the traction sheave rotates, a square wave is produced at the output of AMP1, and filtered by capacitors C1 and C2 to thereby provide a "quasi-sine wave" at the output of AMP2 which is applied to filter 24.

Figure 4:
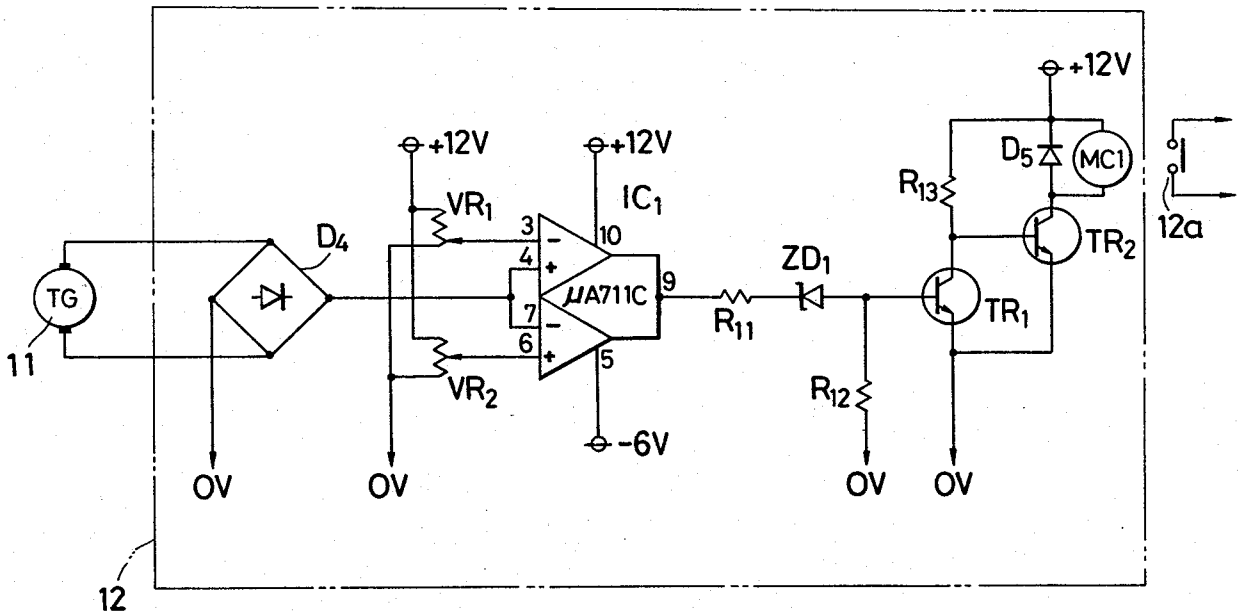

In FIG. 4, a circuit for a speed range detector 12 is shown. This circuit is well known as a window comparator, and composed of a diode bridge D4, a level comparator IC1 like a μA711C, VR1 and VR2 for setting the lower and upper threshold level, resistors R11 to R13, a zener diode ZD1, transistors TR1 and TR2, a diode D5 and a mercury wetted relay MC1 which has output contact 12*a*.

The operation of the control circuit thus organized will be described.

The speed pattern of the speed pattern generator 13 and the speed signal of the tachometer generator 11 are subjected to collation in the speed amplifier 14, and the resultant difference signal is amplified and then applied to the current amplifier 15. The output of the current amplifier 15 controls the DC power produced by the thyristor converter 9. As a result, the speed of the armature 4 is changed and the speed of the cage 1 is precisely controlled through the sheave 3 and the main rope 6.

It is assumed that the traction sheave 3 is slightly eccentric or unbalanced in moment. When the cage 1 is moved upwardly, the relay contact means 20 is closed. The magnetic element 17 and the upward movement position detector 18 are arranged so that they confront each other when the cage chamber 1*a* senses the vibration transmitted from the traction sheave 3. Whenever the magnetic element 17 and the position detector 18 confront with each other, the position detector 18 is closed. The cancellation signal generating circuit 23 provides a cancellation signal in synchronization with the input, and this signal is quasi-sine wave owing to capacitors C1 and C2.

If, in this case, the magnitude of the vibration is changed by the load in the cage 1, then the load detecting device 1*c* provides an output signal and as a result the amplitude of the cancellation signal is changed. This is attained by the CdS opto-isolator OI1. The amplitude of the cancellation signal is selected to be high enough to cancel the force of vibration applied by the vibrating elements. When the speed of the cage 1 reaches the speed range set in the speed range detecting circuit 12, the contact 12*a* is closed. This is attained by the window comparator in FIG. 4. Thus, the cancellation signal is applied to the current amplifier 15. And the armature current is controlled, so that the vibration from the traction sheave 3 is cancelled.

The filter 24 is provided to reduce the shock which is caused by the operation of the contact 12. The timing of generation of the cancellation signal can be controlled by suitably changing the mounting positions of the position detectors 18 and 19.

In the above description, the quasi-sine wave signal is employed as the cancellation signal, however, it may be a pulse signal. A pulse signal corresponding to the maximum and minimum peaks of the quasi-sine wave signal is sufficient for practical use in the system.

The provision of the two position detectors, the upward movement position detector 18 and the downward movement position detector 19 is for the following reason. The control system includes a time delay. Therefore, if the cancellation signal generating circuit 23 produces an output representing the cancellation signal at the same position for both the upward movement and the downward movement, it is impossible to sufficiently cancel the vibration. That is, it is necessary to apply the cancellation signal to the current amplifier 15 as early as possible to compensate for the time delay in the control system.

In the above-described embodiment, the traction sheave 3 is eccentric or unbalanced in moment. However, in the case where the armature 4 is eccentric or unbalanced in moment, the vibration can be cancelled in the same manner. Furthermore, in the case where the vibration is caused by the secondary sheave 5 or the compensator sheave 7, the vibration can be eliminated by providing a magnetic element (17) on it and disposing positions detectors (18 and 19) to cooperate with the magnetic element. Hence, the system is operable in the cases where any of the rotary elements are unbalanced.

In the case where one revolution of the armature 4 generates the force of vibration n times, n magnetic elements 17 should be provided.

The embodiment of the invention has been described with reference to the case where the DC motor is employed. However, it is apparent that the technical concept of the invention is applicable to the case where an electric motor fundamentally having torque rippled is employed, as in the case where an AC motor is driven by power supply having variable voltage and frequency.

As is apparent from the above description, in this invention, the position at which the rotary elements driven by the motor cause the vibration torque is detected to output the signal enough to cancel the vibration torque, and the current corresponding to the signal is applied to the motor. Therefore, even if the rotary elements are eccentric or unbalanced in moment, or the motor outputs the torque ripples, to cause the vibration, the control device according to the invention operates so that the vibration is not sensed in the cage.

Furthermore, according to the invention, the cancellation signal is provided when the speed of the cage reaches the speed range in which the vibration occurs. Therefore, the unwanted external disturbance can be eliminated, and the control operation is effectively carried out.

What is claimed is:

1. A control device for an elevator, comprising:

(a) rope means connected to a cage;

(b) rotary elements driven by an electric motor;

(c) position detecting means for detecting the position of at least one of said rotary elements causing vibration torque, to provide an output signal, said position detecting means comprising an upward movement position detector and a downward movement position detector, whereby said output signal is provided having different phases for upward and downward movement of said elevator;

(d) a cancellation signal generating circuit for providing a cancellation signal in response to said output signal of said position detecting means; and (e) a control circuit for receiving said cancellation signal to apply current necessary to cancel said vibration torque to said electric motor.

2. The control device of claim 1 wherein at least one of said rotary elements includes switch activating means which rotate with said at least one of said rotary elements, said upward and downward position detecting means comprise first and second switches, respectively, said first and second switches being activated by the juxtaposition of said switch activating means with said first and second switches.

3. The device of claim 2 wherein said first and second switches are angularly displaced from each other whereby said first and second switches are activated at different times upon the rotation of said switch activating means.

4. The device of claim 2 or 3 wherein circuit means are provided (i) to exclusively place one of said first and second switches in communication with said cancellation signal generating circuit when said elevator moves upwardly, and (ii) to exclusively place the other of said first and second switches in communication with said cancellation signal generating circuit when said elevator moves downwardly.

5. A control device as in claim 1 further comprising:

(f) a speed range detecting circuit which operates when the speed of said cage is in a predetermined range; and (g) contact means for connecting said cancellation signal generating circuit to said control circuit when said speed range detecting circuit is operated.

6. A control device for an elevator, comprising:

(a) rope means connected to a cage;

(b) rotary elements driven by an electric motor;

(c) position detecting means for detecting the position of said rotary elements causing vibration torque, to provide an output signal;

(d) a cancellation signal generating circuit for providing a cancellation signal in response to said output signal of said position detecting means;

(e) a control circuit for receiving said cancellation signal to apply current necessary to cancel said vibration torque to said electric motor;

(f) a speed range detecting circuit which operates when the speed of said cage is in a predetermined range; and (g) contact means for connecting said cancellation signal generating circuit to said control circuit when said speed range detecting circuit is operated.

7. A control device as claimed in claim 6, in which said position detecting means comprises an upward movement position detector and a downward movement position detector.

8. A control device as in claim 5 or 6 further comprising a speed pattern generating circuit, a tachometer producing a signal indicative of electric motor rotation rate and a differential amplifier receiving the outputs of said tachometer and said speed pattern generating circuit and delivering a difference signal output to said control circuit.

9. The control device as claimed in claim 1, 7 or 5 wherein said control circuit comprises a current amplifier receiving said cancellation signal and a thyristor converter receiving said amplifier output thereby varying the input electric power to said electric motor.

10. The control device of claim 9 further comprising a speed pattern generating circuit, a tachometer producing a signal indicative of electric motor rotation rate, and a differential amplifier receiving the output of said tachometer and said speed pattern generating circuit and delivering a difference signal output to said current amplifier.

* * * * *